United States Patent [19]

Trufitt et al.

[11] 4,414,061

[45] Nov. 8, 1983

[54] TWIN WIRE PAPER FORMING APPARATUS

[75] Inventors: Alton D. Trufitt, Eltham, Australia; David J. Bringman, Bolton, England

[73] Assignees: Australian Paper Manufacturers Limited, South Melbourne, Australia; Beloit Corporation, Beloit, Wis.

[21] Appl. No.: 305,868

[22] Filed: Sep. 28, 1981

Related U.S. Application Data

[63] Continuation of Ser. No. 2,075, Jan. 8, 1979, abandoned, which is a continuation of Ser. No. 792,983, May 2, 1977, abandoned.

[30] Foreign Application Priority Data

Feb. 20, 1975 [AU] Australia ..... PC0668
May 4, 1976 [GB] United Kingdom ..... 18077/76

[51] Int. Cl.[3] ..... D21F 1/48

[52] U.S. Cl. ..... 162/295; 162/301; 162/303; 162/312; 162/363

[58] Field of Search ..... 162/301, 303, 308, 312, 162/351, 363, 217, 300, DIG. 7, 295

[56] References Cited

U.S. PATENT DOCUMENTS

| | | | |
|---|---|---|---|
| 2,881,671 | 4/1959 | Thomas . | |
| 2,881,675 | 4/1959 | Thomas . | |
| 3,232,825 | 2/1966 | Robinson et al. . | |
| 3,240,665 | 3/1966 | Robinson et al. . | |
| 3,382,143 | 5/1968 | Justus et al. | 162/303 |
| 3,403,073 | 9/1968 | Moran . | |
| 3,438,854 | 4/1969 | Means . | |
| 3,540,981 | 11/1970 | Finnila et al. . | |
| 3,839,143 | 10/1974 | Suckow . | |
| 3,844,881 | 10/1974 | Moody | 162/300 |
| 3,846,233 | 11/1974 | Kankaanpaa | 162/312 |
| 3,884,756 | 5/1975 | Gustafson | 162/306 |
| 3,994,774 | 11/1976 | Halme | 162/301 |

*Primary Examiner*—Peter F. Kratz
*Attorney, Agent, or Firm*—D. J. Veneman; G. A. Mathews; M. L. Gill

[57] ABSTRACT

A twin wire papermaking machine which has a multi-chambered suction dewatering device located over the forming wires downstream from the forming roll. The dewatering device deflects the forming wires into a concave path to aid in formation and dewatering.

4 Claims, 2 Drawing Figures

TWIN WIRE PAPER FORMING APPARATUS

This is a continuation of application Ser. No. 2,075 filed Jan. 8, 1979, abandoned which is a continuation of Ser. No. 792,983 filed May 2, 1979, both abandoned.

BACKGROUND OF THE INVENTION

The invention relates to the dewatering of fibrous suspensions on a twin wire papermaking machine of the inverted type, i.e. machines wherein water is removed predominately upwardly by suction boxes located above the top forming wire of a substantially flat run of a continuously-moving sandwich formed by the top and bottom wires and a layer or web of fibrous suspension between them. This type of machine is particularly applicable to the production of multi-ply webs in which case subsequent plies are formed on a layer or web of fibrous suspension carried by one or more previously formed plies.

Known machines of this type include a large diameter forming roll having an open surface. Some initial upward drainage into the cellular surface of this roll may occur just behind the contact point between the roll and the top wire. The lowest point of the forming roll is level with or slightly below the running level of the bottom wire. This results in a slight "wrap" of the bottom wire around the forming roll and creates a narrow arcuate suction pressure zone behind the perforated forming roll, which depends on the tension of the bottom wire. This pressure per unit width of the roll, is indicated by the ratio of wire tension to roll radius. This tension or pressure tends not only to squeeze water from the suspension but also, unfortunately, to restrict the depth of fibre suspension that can traverse the forming zone and hence force the incoming flow to reverse direction forming a "puddle" in the nip between the forming roll and the bottom wire. In practice, the size of this puddle can be reduced by increasing the consistency of the fibre suspension thereby reducing its depth.

A second drainage may occur at the point where the top wire "wraps" the so-called underwire or table roll. Although the curvature of this zone is greater than the forming zone, their respective pressures are comparable due to a lower tension in the top wire. If the forming roll be raised in an attempt to reduce the wrap, there is a tendency for undesirable quantities of water to pass by the first table roll and to form a reverse flow "puddle" at a high curvature zone behind the table roll due to large pressure imposed by the so-called "autoslice" soon to be described. This problem has usually made it necessary to use high consistency suspension, i.e. to ensure that the fibre suspension entering the system has a low water content.

The autoslice may be a suction box or suction water scoop with an extended spout and a blade extending toward the forming roll. Its function is to collect water adhering to the upper surface squeezed out of the top wire, the fibre suspension in the forming zone and the table roll zone. The blade should just skim the top wire, but in practice it is often depressed into the wire run to increase the wrap of the table roll. This has the counter-effect of increasing the pressure at the slice lip which is already high due to its being substantially a "line" contact. Thus, apart from problems due to wear, the sheet must be formed so as to withstand high pressure at the slice lip. Hence all effective forming must take place between the forming roll and the table roll.

Further water removal and hence further consolidation of the fibre sheet has been obtained by the inverted suction boxes over the top wire, downstream from the forming zone.

Raising the forming roll tends to increase back flow at high pressure around the autoslice. If the autoslice also is raised in an attempt to relieve this pressure, the top and bottom wires tend to separate and the fibre sheet to disrupt, and so the remedy may lead to problems more serious than those it is designed to cure. Furthermore, suction boxes tend to wear to a concave formation and this also tends towards wire separation and sheet disruption.

SUMMARY OF THE INVENTION

According to the present invention, dewatering apparatus is provided consisting of a suction box shaped such that the area contacting the wire is curved convexly in the plane parallel to the direction of motion of the wire. The device is adjusted so that the open area between the wires can be varied. The radius of curvature of the dewatering device may be relatively large, in the range 50 to 400 inches so that pressure between the wires, due to bottom wire tension, is only a few inches water-gauge and does not substantially impede the passage of even a low consistency fibre suspension into or through the region in the immediate vicinity of the suction box.

In use, the suction box of the invention is so arranged as to depress the traveling wire sufficiently to cause the latter to follow the convex surface and prevent substantial separation of the wires and consequent disruption of the sheet, but not so low as to constrain the sandwich into high curvature which tends to impede the passage of fibre. A radius of 240 inches has proven to be an operable figure. The variation of the open area of the curved surface of the suction box contacting the wire may be obtained by forming the surface from a plurality of bars or foils extending transversely across the box, at least some of the bars or foils may be replaceable with others of different size.

The suction box must also be mounted so that it may translate in the horizontal direction. This permits the suction dewatering device to be placed at the optimum distance from the headbox. The adjustable positioning feature of the suction box structure in the downstream direction allows one to control the extent of upward dewatering. Fine paper stock requires two-sidedness and an even distribution of fillers throughout the web. To achieve this object, approximately 40 to 60 percent of the water within the web should be removed in the upward direction.

The instant invention may also be used to add additional dewatering capacity to an existing Fourdrinier forming table. The suction dewatering device would be located downstream of the primary headbox and can be used to assist dewatering at a rate ranging from 15 to 25 gallons per minute per inch of suction width. This additional dewatering capacity could be used to shorten the overall length of the forming section or could be used to augment the dewatering capacity of an existing Fourdrinier. The improved formation which results from upward dewatering enhances the range of webs which may be made on a Fourdrinier machine.

An object of this invention is to provide for an improved dewatering of a fibre suspension in sandwich-formation between two moving wires, and to overcome or at least alleviate the above described difficulties that arise in the forming process.

BRIEF DESCRIPTION OF THE DRAWINGS

The invention will now be further described by way of example with reference to the accompanying drawings in which.

Figure 1:
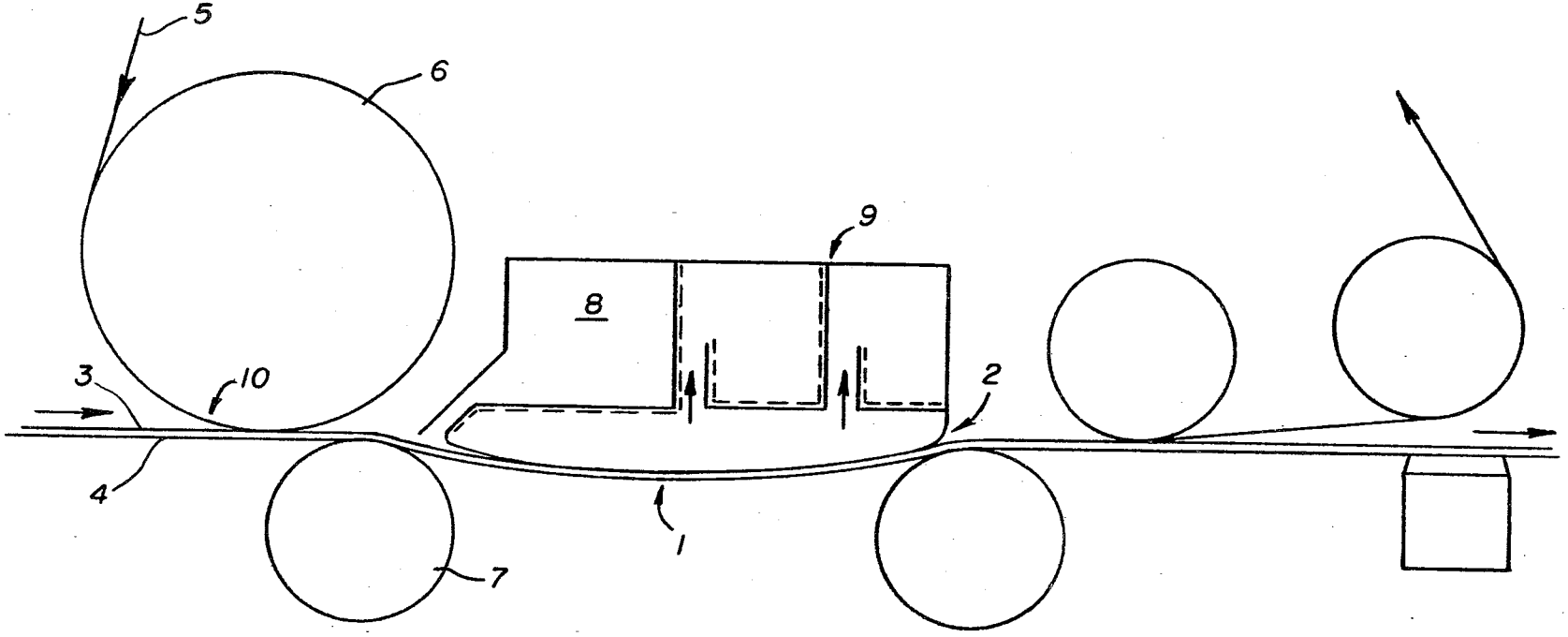
FIG. 1 is a schematic diagram of a dewatering apparatus according to the invention.

The schematic arrangement of FIG. 1 includes a combination of autoslice and suction boxes in a unitary compartment housing. This arrangement permits of a compact forming zone and in combination with the mild curvature imposed upon region 1 by the convexity of the suction housing 2, allows the application of dewatering pressure to be distributed as desired over an appropriate length of travel of the web.

The fibre suspension 3 is deposited on the bottom wire 4 or on one or more previously formed plies carried on wire 4. The top wire 5 is led towards the suspension 3 round a forming or turning roll 6. After passing between roll 6 and an underwire roll 7 sandwiched between wires 4 and 5, the suspension 3, with or without underlying previously-formed ply or plies, is carried beneath suction housing 2 where it is dewatered upwardly by an autoslice 8 and inverted multi-chambered suction box 9.

If desired, the degree of vacuum may be the same in the autoslice 8 and suction box 9, or may increase "downstream" from one compartment to the next.

The suction box is so constructed that the "open" area of the suction surface may be varied by interchangeable foil structure, according to the consistency of the suspension being treated and the degree of formation required.

The suction box of the present invention may be advantageously arranged to contain a number of independent adjacent vacuum chambers. An operable embodiment has been built which utilizes two chambers. However, closer control over web formation is more easily obtained with a larger number of chambers. It should also be noted that depressing the traveling wires into an arcuate path has a tendency to insure that they will travel at the same speed. It has been noted that variations in speed of forming wires will cause sheet disruption.

In practice it has been found, in forming heavy sheets, that sheet quality may be enhanced if the height of the forming roll 6 is adjusted to provide a very small wrap at region 10. The forming roll 6 does not contact the fibre and can be replaced by a small solid turning roll. Such is less cumbersome and expensive than the open surface roll 6 and does not require the use of high pressure sprays to clean its surface. Furthermore, its smaller size permits of a useful reduction in the overall length of the station and hence in the length and cost of the building required to accommodate it.

The aforementioned convexity of the housing need not be uniform. If desired, it may vary, e.g. from a larger to a smaller radius in a downstream direction, and any curvature variation may be related to the size, shape and degree of vacuum in its several compartments, e.g. for the purpose of achieving the desired distribution of the dewatering or forming operation lengthwise of the web. This variation may be in-built, or may be achieved by appropriate profiling of removable bars or foils as hereafter described. The form and effect of the convex surface may be satisfactorily realized and attained by a series of individually replaceable blades, bars or foils which, being preferably flat, can be easily produced by conventional milling or planing machines without the need to generate curved profiles. The body of the box may form a series of flats or short chords along the "arc" thus approximated. Additionally or alternatively, the relevant part of the box could be machined to receive multiblade section preformed to the required curvature.

Advantageously the underwire roll 7 shown in FIG. 1 may be replaced by a plate curved to a single radius larger than that of the roll it substitutes, or to radii progressively decreasing along the arc length of the plate. The function of such plate would be to keep the inter-wire pressure at a controlled low value during the initial dewatering phase. It may generally be found that substitution of such a plate for the underwire roll may allow deeper fibre suspensions to enter the zone immediately upstream of suction apparatus 2.

Figure 2:
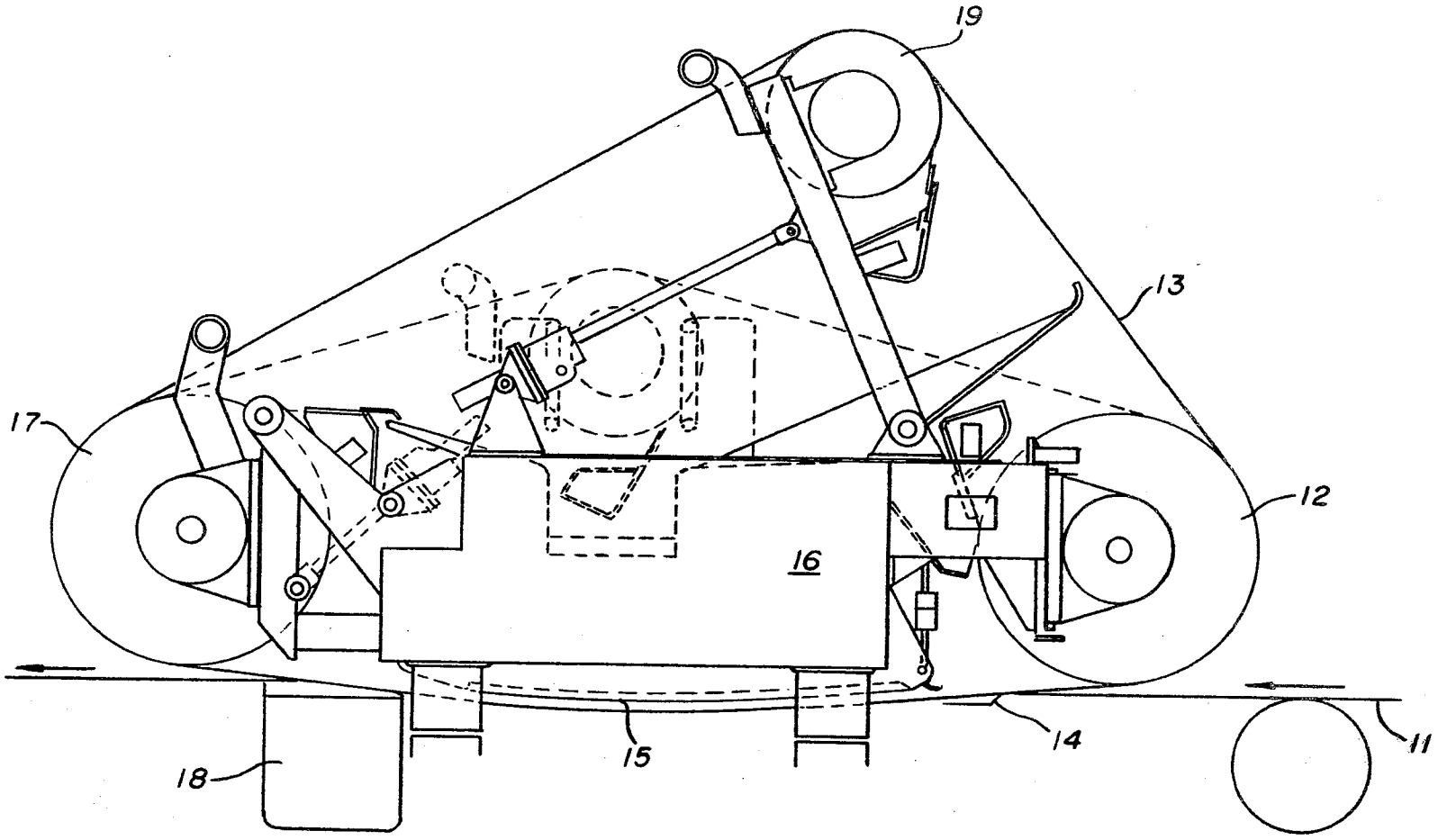
FIG. 2 is a practical embodiment of such an apparatus shown in elevational view.

Referring to FIG. 2, a practical form of the invention is illustrated, the direction of papermaking here being from right to left. The bottom wire 11 carrying the fibrous suspension either directly on it or on a previously formed ply carried by the wire is led below a solid turning roll 12, which leads top wire 13 onto the top of the suspension to form a sandwich. An optional foil 14 may be provided at the point of formation of the sandwich if required. The function of foil 14 may also be achieved by using a curved shoe or rotating roll. The sandwich then passes beneath the curved surface 15 of suction arrangement 16, where upward dewatering takes place as previously described. Afterwards top wire 13 is led away around turning roll 17 and the formed web is carried onwardly for further treatment, or for the addition of another ply thereto, on bottom wire 11. A convexly curved suction box 18, which may in alternative constructions be a suction roll or foil, creates a negative pressure below wire 11 to ensure retention of the formed web on the wire. This negative pressure also served to compact or consolidate the newly-formed web. Top wire 13 is then led round further turning and tensioning roll 19 before returning to solid roll 12.

It will be evident from the foregoing, that the invention provides for simple and convenient improvement of the dewatering of fibre, while avoiding wire separation and consequent risk of disruption of the web. During the drainage period, while the wires and pulp mass are sandwiched together, there is a stability resulting from the fact that the "sandwich", is trained around the convexly-curved surface 15 of suction arrangement 16, and this obviates the possibility of stock disruption during the web formation period.

Additionally the replaceable blades, bars or foils may be individually replaced or remachined to compensate for localized wear.

It is to be appreciated that the prior art type of "inverted forming machine", might easily embody six or seven rolls of fairly large diameter, all requiring support from cross machine members. The present invention provides a greatly simplified construction, obviating many of the supports previously required in the form of cross beams or cross ties and, as may be seen from FIG. 2, the greatly reduced number of rolls can all be carried from the main suction arrangement 16.

Finally, it is to be understood that various alterations, modifications and/or additions may be introduced into the constructions and arrangements of parts previously described without departing from the ambit of the invention.

What is claimed is:

1. Apparatus for forming a paper web from a dilute, aqueous slurry of fibers comprising, in combination:

a looped upper forming wire;

a looped lower forming wire;

means for supporting the upper and lower forming wires in opposed, substantially horizontal relationship for receiving an aqueous slurry of fibers to be dewatered therebetween;

a stationary dewatering device mounted within the looped upper forming wire and including (a) an autoslice mounted in water skimming relationship with the upper forming wire for urging the water into the autoslice for removal therefrom, said autoslice being capable of applying sub-atmospheric pressure to the water;

(b) a suction box having a convexly curved pervious working surface with a radius between about 50 inches to about 400 inches and mounted within the looped upper forming wire positioned closely adjacent and downstream of the autoslice with the working surface bearing downwardly against the upper forming wire to cause the upper and lower forming wires to define a smooth upwardly concavely curved path over the working surface throughout at least a portion of their substantially horizontal path of travel, whereby a significant amount of water is removed upwardly from the aqueous slurry of fibers through the upper forming wire over the curved pervious working surface to form the paper web;

first and second means positioned within the lower forming wire substantially upstream and downstream, respectively, of the stationary dewatering device for creating negative pressure beneath the lower forming wire.

2. The apparatus as set forth in claim 1, wherein:

the curved working surface is cylindrical having a radius of about 240 inches.

3. The apparatus as set forth in claim 1, wherein:

the first means positioned within the looped lower forming wire comprises a roll.

4. The apparatus as set forth in claim 1, wherein:

the second means positioned within the looped lower forming wire comprises a foil, suction box, or suction roll.

* * * * *